US006999382B2

(12) United States Patent
Horne

(10) Patent No.: US 6,999,382 B2
(45) Date of Patent: Feb. 14, 2006

(54) SIGNAL SPLITTING SYSTEM AND METHOD FOR ENHANCED TIME MEASUREMENT DEVICE OPERATION

(75) Inventor: Steve Horne, El Granada, CA (US)

(73) Assignee: Guide Technology, Inc., Sunnyvale, CA (US)

( * ) Notice: Subject to any disclaimer, the term of this patent is extended or adjusted under 35 U.S.C. 154(b) by 371 days.

(21) Appl. No.: 10/427,729

(22) Filed: Apr. 30, 2003

(65) Prior Publication Data

US 2004/0228220 A1 Nov. 18, 2004

(51) Int. Cl.
*G04F 10/00* (2006.01)
*G04F 8/00* (2006.01)

(52) U.S. Cl. ..... 368/113; 702/176

(58) Field of Classification Search ..... 368/113, 368/117–120; 327/113–117, 269; 702/176–177
See application file for complete search history.

(56) References Cited

U.S. PATENT DOCUMENTS 3,623,092 A 11/1971 Farnsworth
3,656,060 A 4/1972 Bauernfeind et al.
3,794,918 A 2/1974 Mallett et al.
4,641,348 A 2/1987 Neuder et al.
4,695,781 A 9/1987 Ito
6,091,671 A 7/2000 Kattan
6,181,649 B1 * 1/2001 Kattan ..... 368/121
6,226,231 B1 * 5/2001 Kattan ..... 368/113
6,456,959 B1 * 9/2002 Kattan ..... 702/176
6,701,280 B1 * 3/2004 Horne et al. ..... 702/177

* cited by examiner

*Primary Examiner*—Vit W. Miska
(74) *Attorney, Agent, or Firm*—Dority & Manning, P.A.

(57) ABSTRACT

A system and corresponding method for measuring relative timing of signal events in at least one measurement signal includes input circuitry for receiving such a measurement signal. The input circuitry may include a comparator configured to convert the measurement input signal into a binary timing signal that is indicative of selected transitions, or signal events, in the measurement signal. The original measurement signal, or subsequently generated timing signal, is then provided to signal splitting circuitry that is configured to split such signal a predetermined number of times and to generate a plurality of data streams whose frequency level is lower than the frequency level of the original measurement signal. The signal splitting circuitry may correspond to respective pluralities of edge-triggered devices, for example flip-flops, that are provided in a cascaded series of groups, and may in some embodiments further include a plurality of logic gates coupled between selected grouped pluralities of edge-triggered devices as well as delay elements coupled between selected inputs and outputs of the respective logic gates. Once the signal splitting circuitry generates a plurality of parallel data streams representative of the transition information in the original measurement input signal, such parallel data streams can then be relayed to one or more measurement channels such that time-stamped measurements of selected signal events can be obtained by interpolator-based measurement circuitry.

20 Claims, 5 Drawing Sheets

SIGNAL SPLITTING SYSTEM AND METHOD FOR ENHANCED TIME MEASUREMENT DEVICE OPERATION

BACKGROUND OF THE INVENTION

A multitude of test systems and specialized time measurement devices have been developed to test the functional capabilities and reliability of integrated circuit products. One example of a time measurement device can be found in U.S. Pat. No. 6,091,671 (Kattan), which discloses a Time Interval Analyzer (TIA) for measuring time intervals between events in an input signal. Such patent is incorporated herein by reference for all purposes.

In accordance with the time measurement technology disclosed in U.S. Pat. No. 6,091,671, an input signal is received by front-end comparators, whereby a corresponding timing signal is generated. This timing signal is subsequently relayed to an interpolator-based measurement section at a fundamental data rate, which may typically be up to a maximum rate of about 3–4 Gbits/s.

Newly developed integrated circuit products employ rapidly increasing signal frequency levels that approach and sometimes exceed the maximum fundamental data rate of such conventional time interval analyzers. Since a large percentage of TIA test systems operate at such high speeds, it is a concern that various components of a TIA operating at such levels require very careful design and utilize expensive components that are often difficult to procure. Furthermore, such TIA components may be more sensitive to manufacturing variability and defects than components designed for operation at lower speeds.

Another concern related to conventional TIA devices is that as the signal frequency levels of TIA input signals increase, the relative accuracy of measurements obtained by the TIA can significantly decrease. This is due in part to the fact that transmitting shorter pulse widths through multiple stages of logic and/or connecting cables degrades signal accuracy.

Signal frequency levels are increasing at a greater rate than the development of new technological components fast enough to allow direct measurement of ultra high frequency signals, such as on the order of 10 Gbits/s (approximately 3× limit of currently measurable speed). Thus, it is desirable to provide features for improving the measurement of such signals beyond the current state of the art. More particularly, time measurement technology is desired with functionality to accurately measure signals with frequency levels that are at least a half an order of magnitude (i.e., three times) greater than the maximum data rate of conventional time measurement systems.

Time measurement features in accordance with the presently disclosed technology are configured to split an input signal into separate event streams, with each respective event stream having a lower fundamental data rate yet carefully maintained accuracy levels, thus allowing the measurement of such input signals even though their original data rate may otherwise be too high.

SUMMARY OF THE INVENTION

In view of the recognized features encountered in the prior art and addressed by the present subject matter, an improved system and method for measuring input signals with a time measurement device, such as a time interval analyzer, is disclosed. The subject technology includes features for splitting an input signal into separate data streams before such events are measured. The timing signals thus sent to the measurement circuit(s) of a time interval analyzer are characterized by a reduced data rate compared to the original measurement input signal.

Various features and aspects of the subject signal splitting technology as incorporated with signal measurement systems, such as a time interval analyzer, offer a plurality of advantages. More particularly, time measurement technology is provided with functionality to accurately measure signals with data rates that are higher than can be effectively measured with conventional signal measurement systems. As such, time measurement device analysis of a relatively fast measurement input signal is enabled using lower speed measurement hardware.

Another advantage of aspects of the present subject matter is that no signal event data of an original measurement input signal is lost when utilizing the subject technology. Every transition, or signal event, in a given measurement input signal will map to a corresponding signal event in one of the multiple parallel data streams that are generated using the subject signal splitting technology. Likewise, all necessary transitions in the arming signals that may be employed to select the desired signal events for measurement will also be mapped to subsequently generated arming signal streams, also preferably characterized by lower data rates than an original arming input signal.

Yet another advantage of aspects of the present invention is that the signal splitting hardware results in a simplification of the arming hardware in a time interval analyzer or other time measurement device. By reducing the data rate of the signal to be measured, it is easier to "arm" measurement circuitry for obtaining a time-stamped measurement of a desired signal edge without missing the desired edge. Accordingly, it may be possible to implement arming entirely in the digital domain, for example within a logic structure such as a field programmable gate array (FPGA) or other gate array device.

In accordance with exemplary embodiments of the present subject matter, a signal measurement system for measuring relative timing of signal events in at least one measurement signal is provided with input circuitry for receiving such a measurement signal. The input circuitry may be further configured to convert the measurement input signal into a timing signal that is indicative of selected transitions, or signal events, in the measurement signal. In more particular embodiments, the timing signal is generated by a comparator and is characterized as having a generally binary signal format.

The original measurement signal, or subsequently generated timing signal, is then provided to signal splitting circuitry that is configured to split such signal a predetermined number of times and to generate a plurality of data streams whose frequency level is lower than the frequency level of the original measurement signal. The signal splitting circuitry of the present invention may correspond to respective pluralities of edge-triggered devices, such as flip-flops, RC circuits, etc. that are provided in a cascaded series of groups. The number of grouped pluralities of edge-triggered devices may in some embodiments correspond to the predetermined number of times it is desired to split the original measurement input signal. Some signal splitting circuit embodiments may further include a plurality of logic gates coupled between selected grouped pluralities of edge-triggered devices as well as delay elements coupled between selected inputs and outputs of the respective logic gates.

Once the signal splitting circuitry of the present invention generates a plurality of parallel data streams representative of the transition information in the original measurement input signal, such parallel data streams can then be relayed to one or more measurement channels such that time-stamped measurements of selected signal events can be obtained.

The present invention equally concerns various exemplary corresponding methodologies for practice and manufacture of all of the herein referenced signal measurement systems, signal splitting configurations and related time measurement technology.

In accordance with one exemplary embodiment of the subject methodology, a method of measuring relative timing changes in an input signal includes the steps of providing a measurement signal characterized by a first frequency level, splitting the measurement signal a predetermined number of times to generate at least first and second datastreams, and obtaining time-stamped measurements of selected signal events within the generated datastreams. The datastreams generated in the step of splitting the measurement signal are characterized by a second frequency level, where the second frequency level is lower than the first frequency level of the original measurement input signal. The step of splitting the measurement signal may be repeated in some embodiments to generate four or more datastreams that can then be measured in the step of obtaining time-stamped measurements. An optional initial step in such exemplary embodiment is to configure the measurement signal into a generally binary signal format before the step of splitting the measurement signal.

Additional objects and advantages of the present subject matter are set forth in, or will be apparent to, those of ordinary skill in the art from the detailed description herein. Also, it should be further appreciated that modifications and variations to the specifically illustrated, referred and discussed features and steps hereof may be practiced in various embodiments and uses of the invention without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the present subject matter, not necessarily expressed in this summarized section, may include and incorporate various combinations of aspects of features, components, or steps referenced in the summarized objectives above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1:
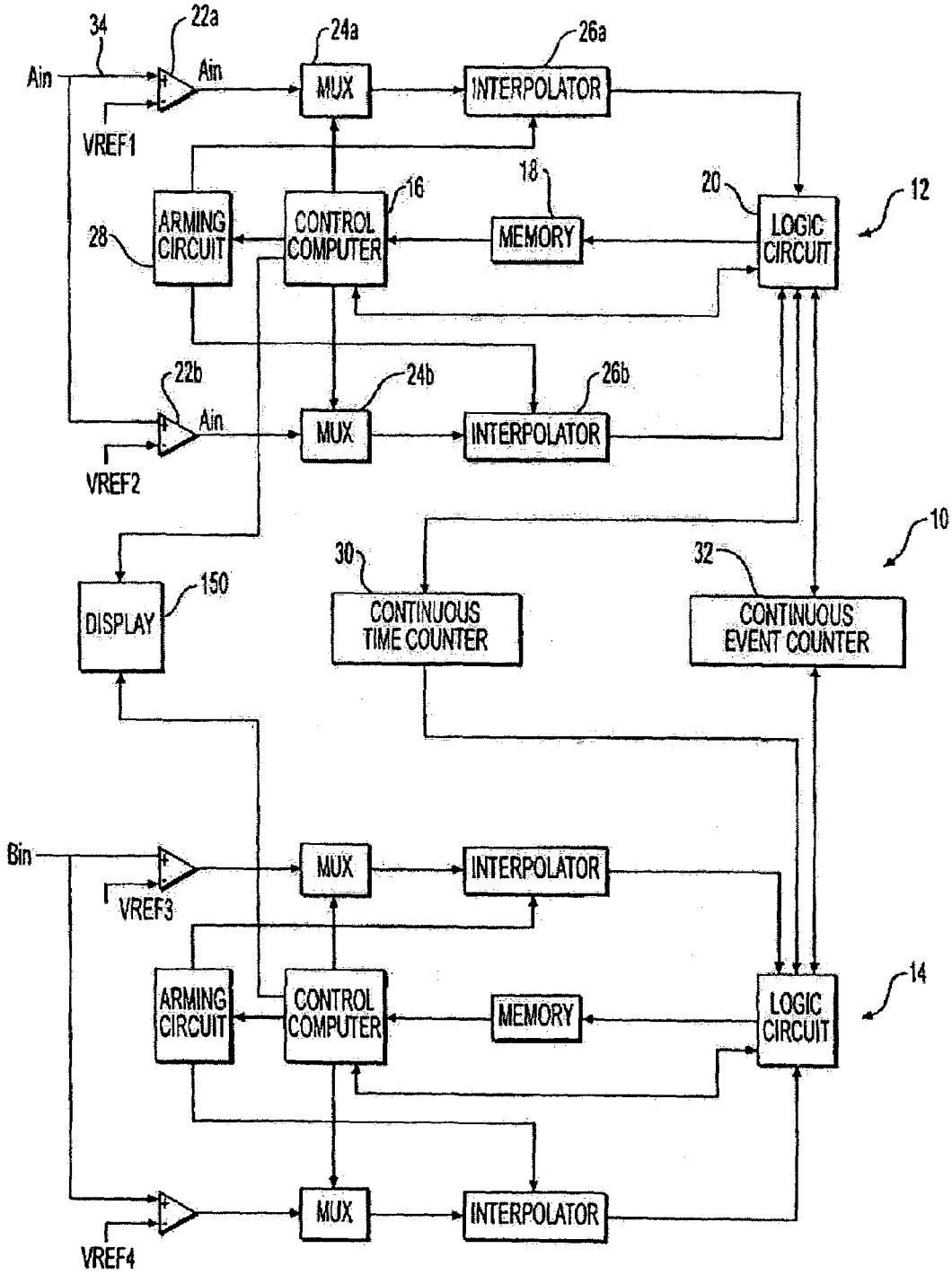
FIG. 1 provides a schematic illustration of an exemplary signal measurement system.

Repeat use of reference characters throughout the present specification and appended drawings is intended to represent same or analogous features or elements of the invention.

DETAILED DESCRIPTION

As discussed in the Summary of the Invention section, the present subject matter is particularly concerned with an improved system and method for measuring input signals with a time measurement device. The subject technology includes features for splitting an input signal into separate event data streams before such events are measured. The resultant data streams sent to the measurement circuit(s) of a time measurement device are characterized by a reduced data rate compared to the original measurement input signal.

Aspects of a signal measurement system in accordance with the present technology can be incorporated with time measurement devices that are capable of measuring relative timing changes of signal events in a measurement input signal. One particular simplified example of a time measurement device with which aspects of the present invention may be incorporated is a time interval analyzer, such as disclosed in U.S. Pat. No. 6,091,671 (Kattan et al.) FIG. 1 provides a schematic illustration of an exemplary such time interval analyzer. Selected aspects of this exemplary time interval analyzer are hereafter presented in order to more clearly understand the operation of the present invention. Additional details related to such exemplary time interval analyzer are disclosed in U.S. Pat. No. 6,091,671, which is incorporated herein by reference for all purposes. It should be appreciated that alternative signal measurement circuitry may also be utilized in accordance with the presently disclosed technology.

Referring now to FIG. 1, a time interval analyzer 10 includes two measurement channels 12 and 14, and may in some embodiments contain many more measurement channels. Each measurement channel includes a control computer 16, for example a 200 MHz DSP processor, with associated memory 18, for example a high-performance FIFO memory, and a logic circuit 20. Alternatively, the channels may share a common computer, memory, and logic circuit, which may collectively be referred to as a processor circuit. Each channel, in turn, includes parallel measurement circuits having comparators 22*a* and 22*b*, multiplexers 24*a* and 24*b*, and interpolators 26*a* and 26*b*. That is, each channel includes multiple, in this case two, measurement circuits. An arming circuit 28 is controlled by control computer 16 to trigger the interpolators. A continuous time counter 30 and continuous event counter 32 provide time and event counts to both channels 12 and 14. Alternatively, each measurement circuit may have its own time counter and event counter, provided that the respective counters for each measurement circuit are synchronized. Channels 12 and 14 are mirror images of each other, and thus discussion herein relative to channel 12 should be understood to be similar with respect to channel 14.

The exemplary time interval analyzer illustrated in FIG. 1 is configured to measure one or more desired characteristics of an input signal. Referring to channel 12, an input signal $A_{in}$ is directed on a signal line 34 to the positive inputs of comparators 22*a* and 22*b*. Each comparator compares $A_{in}$ to reference voltages VREF1 and VREF2, respectively, so that the output of each comparator changes state as $A_{in}$ moves above and below the reference voltage. It should be appreciated that the reference voltages may vary from one another. In other embodiments, the inputs to comparators 22*a* and 22*b* may be a differential signal pair. In such a case, an input signal is typically compared against its signal complement, without the need for reference voltages VREF1 and VREF2.

Referring still to FIG. 1, once a single-ended or differential measurement input signal is provided to a front-end comparator 22*a*, 22*b*, a binary timing signal that has rising edges at the rising edges of the measurement input signal is output to respective multiplexers 24*a* and 24*b*. Multiplexers 24*a* and 24*b* provide an optional selection mechanism for relaying a desired signal to the interpolators 26*a* and 26*b* where time-stamped measurements may then be obtained. The interpolators and other measurement circuitry provided in exemplary time interval analyzer 10 are configured to measure signals having frequencies of up to approximately 3 Gbits/s. Thus, problems arise when a measurement input signal's data rate, or frequency level, is greater than this maximum data rate at which effective measurements can be taken. As such, additional time measurement features in accordance with the present invention are disclosed.

Figure 2:
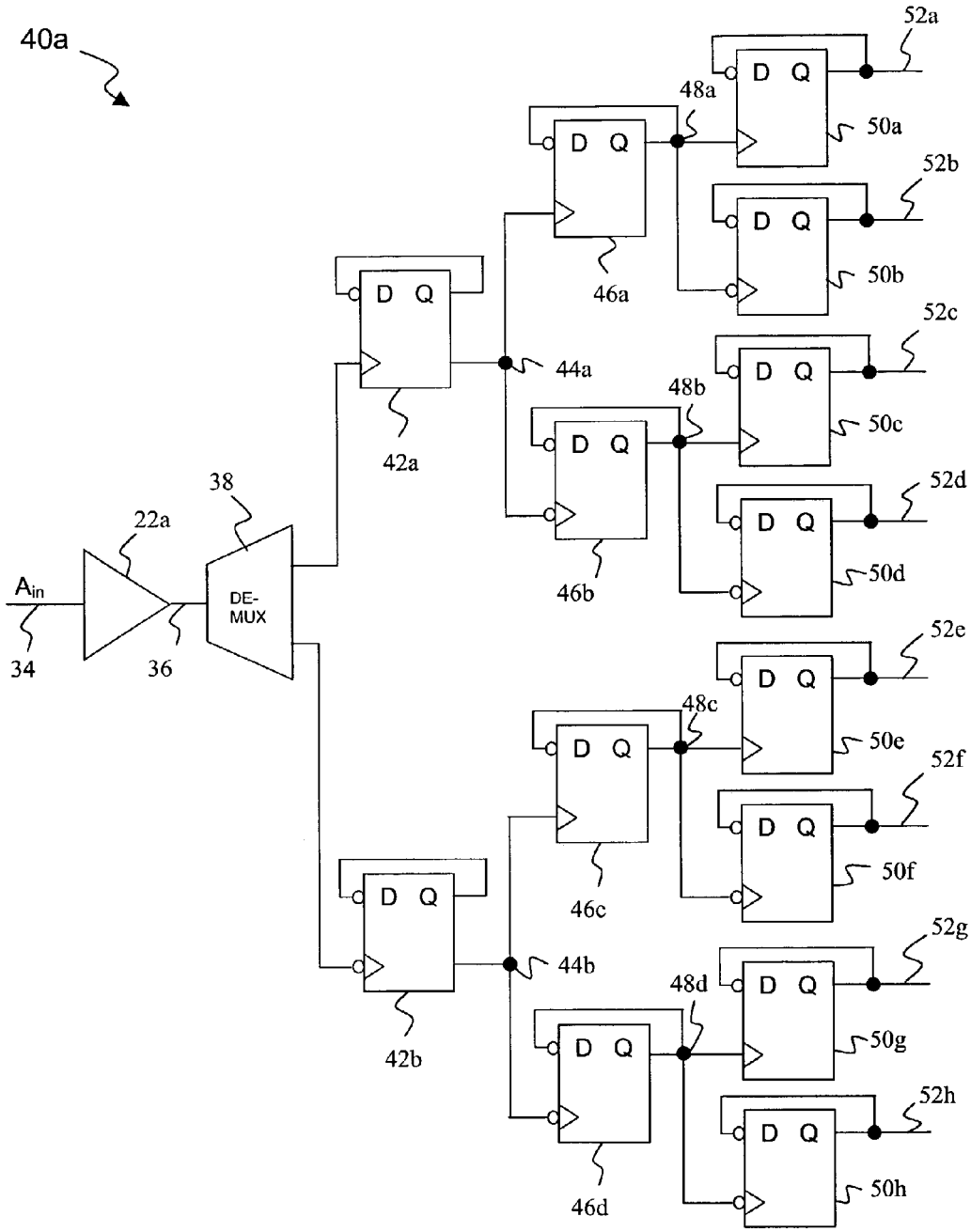
FIG. 2 provides a schematic illustration of a first exemplary signal splitter circuit embodiment in accordance with the present invention.

Referring now to FIG. 2, an exemplary signal splitting circuit 40*a* is presented. This example is simplified for clarity of the invention. Many variations may be done, or components added or exchanged. The exemplary signal splitting technology of FIG. 2 is configured to receive a measurement input signal and subsequently generate a plurality of parallel data streams, or timing signals, having a lower data rate than that of the original measurement input signal. This translates to the minimum period of the generated data streams being greater than that of the measurement input signal. More specifically, when the minimum period of the measurement input signal is some value T, then the minimum signal period of the plurality of generated data streams is n*T, where n is some integer value greater than one. Each transition, or signal event, within each of the resultant data streams has a fixed time relationship to the transition in the original signal to which it corresponds. The times of selected transitions between data streams can then be measured to determine the timing characteristics of the original signal. The exemplary embodiments presented hereafter are presented for incorporation with a time interval analyzer such as illustrated in FIG. 1, but it should be appreciated that aspects of such signal splitting technology can be incorporated with other time measurement devices and signal measurement systems than a time interval analyzer as presented herein.

Exemplary embodiment 40*a* receives a measurement input signal $A_{in}$ on signal line 34 which is then provided to input comparator 22*a*. As previously discussed, the output of comparator 22*a* is a binary timing signal 36 indicative of selected events in the measurement input signal $A_{in}$. The output 36 of comparator 22*a* is then provided to an optional demux, or splitter element, 38 before being relayed to the respective clock inputs of flip-flops 42*a* and 42*b*. Flips-flops 42*a* and 42*b* may, for example, correspond to edge-triggered D-type flip-flops and may be hereafter collectively referred to as a first plurality of flip-flops 42. Although the exemplary embodiment shown in FIG. 2 utilizes edge-triggered flip-flops, it should be appreciated that other circuits such as RC filters, etc. may be used to produce edge-triggered activities. As illustrated, flip-flop 42*a* is configured to receive the timing signal 36 output from comparator 22*a* while flip-flop 42*b* is configured to receive the inverse of such comparator output 36. The first plurality of flip-flops 42 functions to split the original signal into two data streams at signal lines 44*a* and 44*b*, respectively. The signals at lines 44*a* and 44*b* are generated such that their data rate is half that of the signal on line 36.

Signal 44*a* is then fed to the respective clock inputs of flip-flops 46*a* and 46*b*, with flip-flop 46*b* configured to invert the signal 44*a*. Signal 44*b* is then fed to the respective clock inputs of flip-flops 46*c* and 46*d*, with flip-flop 46*d* configured to invert the signal 44*b*. Flip-flops 46*a*–46*d*, collectively referred to as second plurality of flip-flops 46, generate respective signal outputs at signal lines 48*a*–48*d*. These signals are generated such that their data rate is one half that of the signals on lines 44*a* and 44*b*.

Signal 48*a* is then fed to the respective clock inputs of flip-flops 50*a* and 50*b*, with flip-flop 50*b* configured to invert the signal 48*a*. Signal 48*b* is then fed to the respective clock inputs of flip-flops 50*c* and 50*d*, with flip-flop 50*d* configured to invert the signal 48*b*. Signal 48*c* is then fed to the respective clock inputs of flip-flops 50*e* and 50*f*, with flip-flop 50*f* configured to invert the signal 48*c*. Signal 48*d* is then fed to the respective clock inputs of flip-flops 50*g* and 50*h*, with flip-flop 50*h* configured to invert the signal 48*d*. Flip-flops 50*a*–50*h*, collectively referred to as third plurality of flip-flops 50, generate respective signal outputs at signal lines 52*a*–52*h*. These signals are generated such that their data rate is one half that of the signals on lines 48*a*–48*d*, respectively.

It should be appreciated that although only three pluralities, or cascaded groups, of flip-flops are depicted in FIG. 2, many more levels may be provided to further split a given input signal.

With further respect to the exemplary signal splitting circuitry 40*a* depicted in FIG. 2, a preset mechanism exists to reset all the flip-flops for an initial state and to control the handoff between flip-flops 42*a* and 42*b* for an initial signal start. For example, flip-flop 42*a* can be held on reset based on the signal 44*b* output from flip-flop 42*b* (not illustrated in FIG. 2) so that flip-flop 42*a* does not start until flip-flop 42*b* has already started. Accordingly, similar reset/preset arrangements may be implemented for each of the subsequent pluralities of flip-flops. It is important to balance the propagation delays between the distinct pluralities of flip-flops. By implementing such a controlled handoff between flip-flops, an initial measurement signal is sequentially split in a precisely synchronized fashion.

Figure 3:
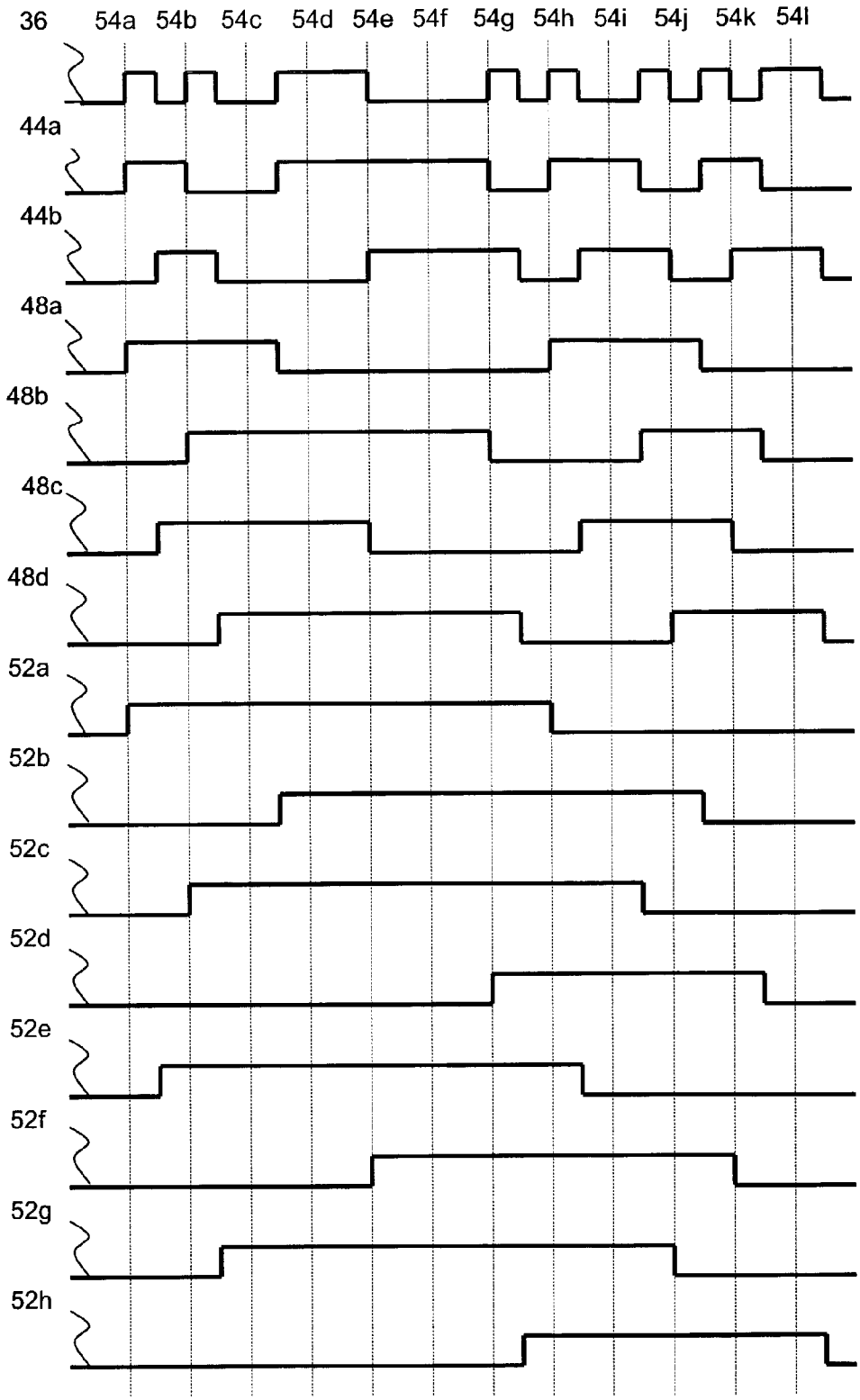
FIG. 3 provides a graphical illustration of a measurement input signal at various points within the exemplary signal splitter circuit of FIG. 1.

Referring now to FIG. 3, a timing diagram illustrates various measurement signals at different points within the exemplary embodiment of FIG. 2, with a given exemplary input signal 36. The timing diagram of FIG. 3 is depicted with the assumption that all integrated circuit components in FIG. 2 are ideal components with no inherent signal propagation delays. The respective clock reference lines 54*a*–54*l* are symbolic lines representative of clock timing used to generate the exemplary input signal 36 in FIG. 3. Clock lines 54*a*–54*l* are not actually available in the signal splitter circuitry of FIG. 2, and the respective pluralities of flip-flops change their states based on the transitions of the actual input signal 36.

The signal splitting circuitry 40*a* of FIG. 2 functions to spread the transitions, or signal events, within signal 36 among multiple data streams. As illustrated graphically in the timing diagram of FIG. 3, the signal splitting embodiment depicted in FIG. 2 effects the generation of the first data stream on signal line 44*a* such that the rising edges of the original timing signal 36 are recorded by toggling between respective binary "0" and binary "1" signal values. Similarly, the falling edges of the original timing signal 36 are recorded at signal 44*b* by toggling between respective binary "0" and "1" signal values. Referring now to the signal outputs of the second plurality of flip-flops 46, the rising edges of signal 44*a* are recorded at signal 48*a*, the falling edges of signal 44*a* are recorded at signal 48*b*, the rising edges of signal 44*b* are recorded at signal 48*c*, and the falling edges of signal 44*b* are recorded at signal 48*d*. Referring to the signal outputs of the third plurality of flip-flops 50, the rising edges of signal 48*a* are recorded at signal 52*a*, while the falling edges of signal 48*a* are recorded at signal 52*b*. The rising edges of signal 48*b* are recorded at signal 52*c*, while the falling edges of signal 48*b* are recorded at signal 52*d*. The rising edges of signal 48*c* are recorded at signal 52*e*, while the falling edges of signal 48*c* are recorded at signal 52*f*. The rising edges of signal 48*d* are recorded at signal 52*g*, while the falling edges of signal 48*d* are recorded at signal 52*h*.

By spreading the transitions within signal 36 among multiple data streams, it is possible to obtain measurements of multiple data streams that correspond to the relative timing characteristics of the original input signal. Such measurements can be effected as long as any signal propagation delays are carefully managed such that respective signal event positions relative to one another are known. This measurement technique does not necessarily require all the signals to have the same delay. The delay of various data streams may be numerically compensated later, for instance after signal measurements are obtained.

Figure 4:
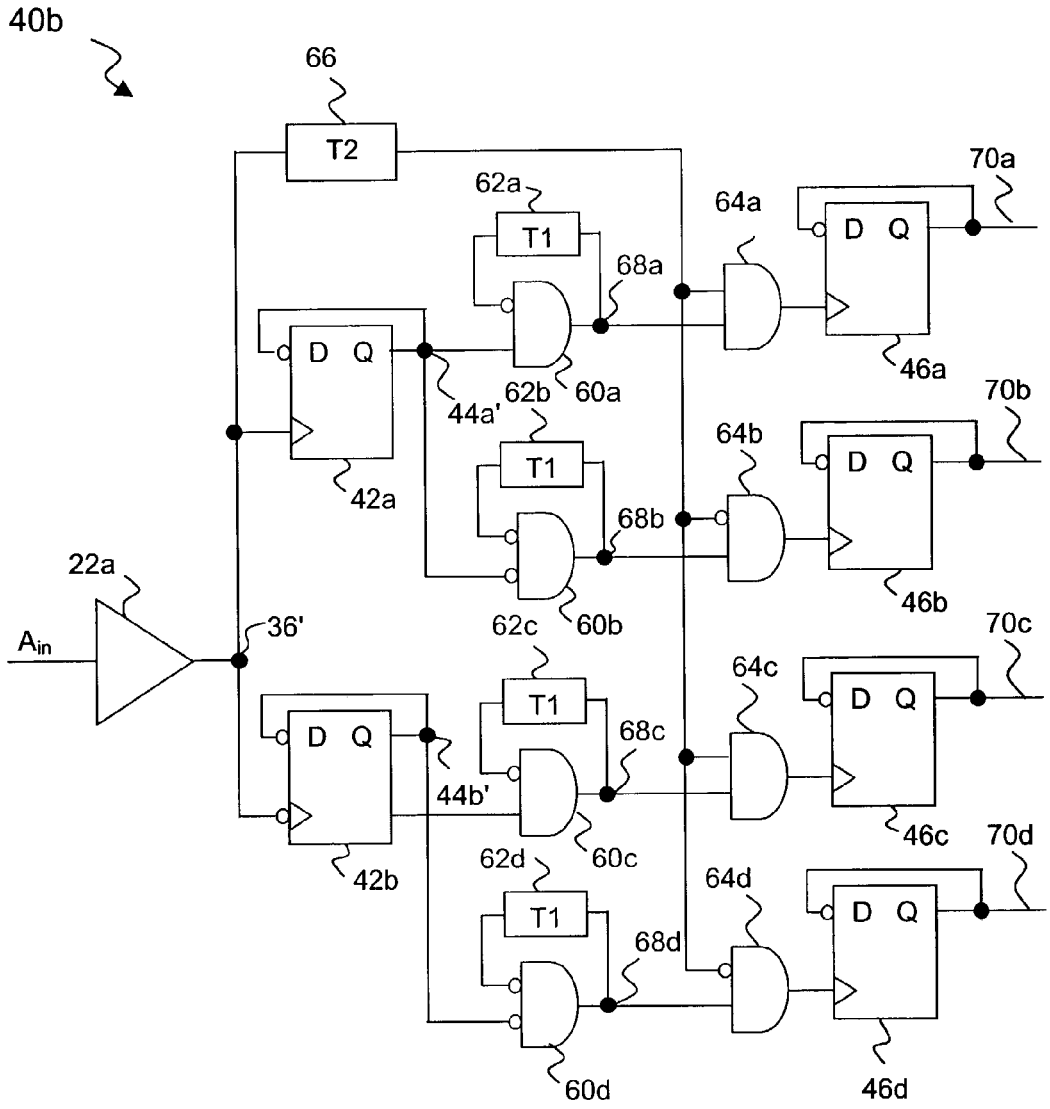
FIG. 4 provides a schematic illustration of a second exemplary signal splitter circuit embodiment in accordance with the present invention.

FIG. 4 illustrates another exemplary signal splitting embodiment 40*b* for generating multiple data streams at a lower data rate than an original input signal, while simultaneously maintaining the timing information about such an input signal. The exemplary embodiment of FIG. 4 offers an advantage to that of FIG. 2 since there are fewer levels of logic through which the measurement input signal must flow, thus resulting in more precisely maintained timing accuracy.

Referring more particularly to the exemplary signal splitter embodiment 40*b* of FIG. 4, an input signal $A_{in}$ is provided to input comparator 22*a*, whereby a binary timing signal is generated at signal line 36'. Timing signal 36' is then provided to the respective clock inputs of flip-flops 42*a* and 42*b*, with flip-flop 42*b* being configured to invert signal 36'. Flip-flops 42*a* and 42*b* generate respective output signals 44*a*' and 44*b*'. Signal 44*a*' is then provided as a first input to respective combinatorial AND gates 60*a* and 60*b*, with AND gate 60*b* configured to invert signal 44*a*'. Signal 44*b*' is provided as a first input to respective combinatorial AND gates 60*c* and 60*d*, with AND gate 60*d* configured to invert signal 44*b*'. A second input to each respective AND gate 60*a*–60*d* is provided as an inverted feedback from each respective gate output that is fed through respective delay elements 62*a*–62*d* that implement respective timing delays of a predetermined duration T1. The respective outputs 68*a*–68*d* of AND gates 60*a*–60*d* are relayed to a first input of combinatorial AND gates 64*a*–64*d*. A second input to each respective AND gate 64*a*–64*d* corresponds to the timing signal 36' fed through a delay element 66, which implements a timing delay of a predetermined duration T2. AND gates 64*b* and 64*d* are configured to invert such second input. The output of each AND gate 64*a*–64*d* is then provided as a clock input to respective flip-flops 46*a*–46*d*, which in turn generate signal outputs 70*a*–70*d*. Although the exemplary embodiment shown in FIG. 4 utilizes edge-triggered flip-flops, it should be appreciated that other circuits such as RC filters, etc. may be used to produce edge-triggered activities.

It should be appreciated that although only four data streams 70*a*–70*d* are generated from a single input signal in FIG. 4, the input signal may be split any additional number of times.

Delay elements 62*a*–62*d* and 66 can be implemented in any number of fashions as understood by one of ordinary skill in the art. For example, a delay can be implemented by a delay line, a digital signal processor, a delay counter which simply inserts a time delay in a given sequence of events, or a delay circuit in which the output signal is delayed by a specified time interval with respect to the input signal, as simple as a longer trace or wire in some cases. Delay elements 62*a*–62*d* and 66 may be digital devices and may have a fixed or user programmable delay interval. Typically, the duration of timing delays T1 and T2 are less than or equal to one period of the virtual clock speed of the timing input signal 36'. If such delays were to exceed that clock speed, proper latching of the signal would not be achieved. The duration of timing delays T1 and T2 may be generally equal to the propagation delay of gate 60*a*.

Figure 5:
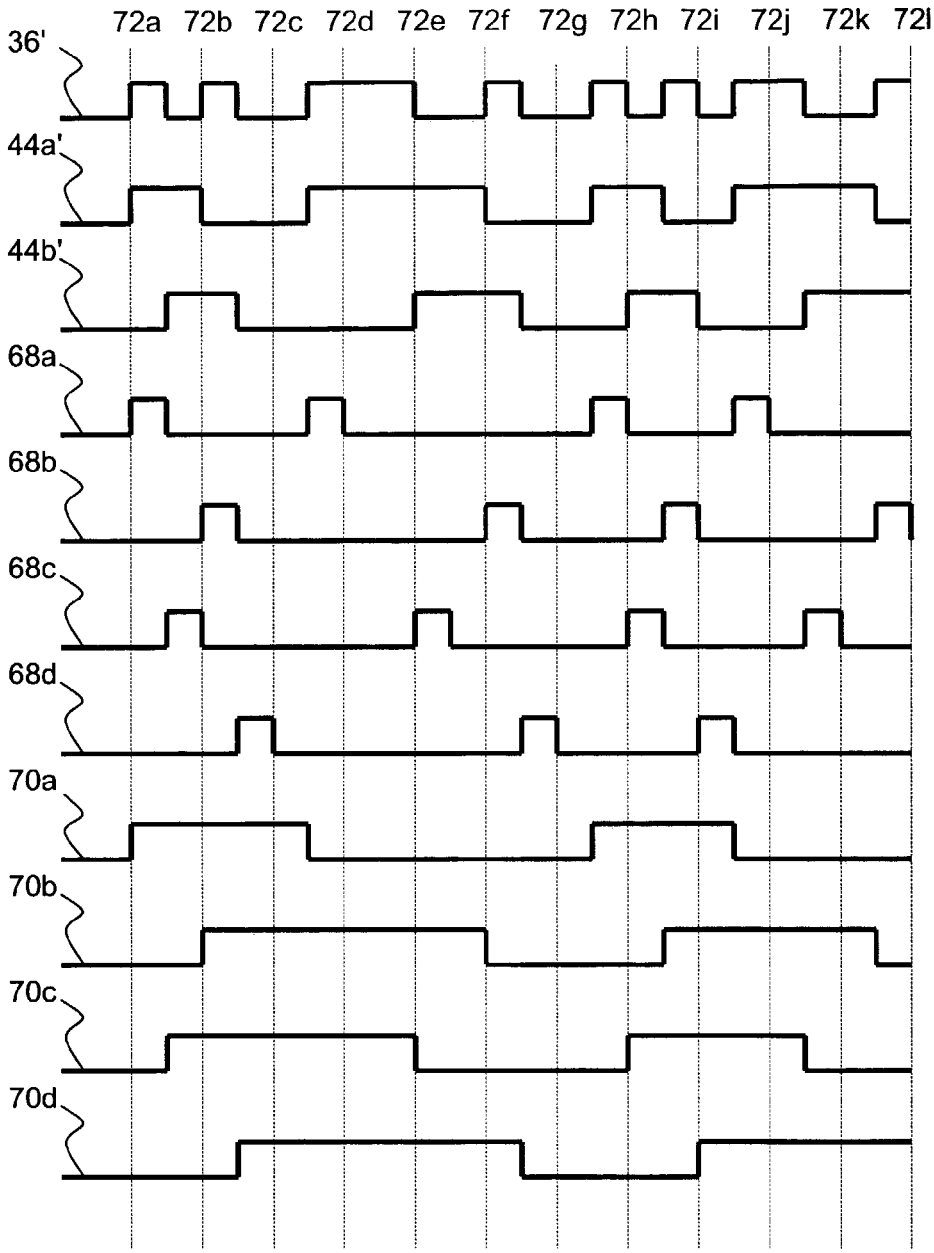
FIG. 5 provides a graphical illustration of a measurement input signal at various points within the exemplary signal splitter circuit of FIG. 4.

Referring now to FIG. 5, a timing diagram illustrates various measurement signals at different points within the exemplary embodiment of FIG. 4, with a given exemplary input signal 36'. The timing diagram of FIG. 5 is depicted with the assumption that all integrated circuit components in FIG. 4 are ideal components with no inherent signal propagation delays. The respective clock lines 72*a*–72*l* are symbolic lines representative of clock timing used to generate the exemplary input signal 36' in FIG. 5. Similar to the timing diagram of FIG. 3, the rising edges of the original timing signal 36' are recorded in the data stream on signal line 44*a*' by toggling between respective binary "0" and binary "1" signal values. Similarly, the falling edges of the original timing signal 36' are recorded at signal 44*b*' by toggling between respective binary "0" and "1" signal values. The outputs 68*a*–68*d* of AND gates 60*a*–60*d* are short, positive pulses, wherein each pulse is determined by the fixed delays T1 and is generally shorter in length that two periods of the original timing signal 36'. These signals 68*a*–68*d* are then used to gate the original signal to the clock inputs of AND gates 64*a*–64*d*. Delay element 66 with fixed delay T2 delays the original signal 36' to meet the clock setup time for gates 64*a*–64*d*. In this way, the accuracy is determined by at most one combinatorial AND gate and one flip-flop, regardless of how many times the signal is split. In the exemplary case of FIG. 4 in which a single measurement input signal is split into four data steams, the accuracy-related advantages may be relatively nominal compared to embodiments in which the original input signal is split an additional number of times.

As seen from the exemplary timing diagrams in FIGS. 3 and 5, every transition, or signal event, within the plurality of data streams generated in the exemplary signal splitting circuitry embodiments has a fixed time relationship to the transitions in the original measurement signal. Consider the timing diagrams in FIG. 5 and assume that each transition in the measurement signal 36' is assigned a unique event number. For instance, the rising edge transition at reference clock line 72*a* is Event 1 (E1), the falling edge transition between reference clock lines 72*a* and 72*b* is Event 2 (E2), the rising edge transition at reference clock line 72*b* is Event 3 (E3), and so forth. Now consider the original signal events, and where those corresponding events are located on the data streams 70*a*–70*d*. Table 1 below provides a related table of such corresponding signal transitions for the rising and falling edges.

TABLE 1

| Event in Signal 36': | Location Relative to Clock Lines: | Corresponding Data Stream Location: | Rising Edge Event Count: | Falling Edge Event Count: |
|---|---|---|---|---|
| E1 | At 72a | Rising Edge 1 in 70a | 1 | — |
| E2 | Between 72a and 72b | Rising Edge 1 in 70c | — | 1 |
| E3 | At 72b | Rising Edge 1 in 70b | 2 | — |
| E4 | Between 72b and 72c | Rising Edge 1 in 70d | | 2 |
| E5 | Between 72c and 72d | Falling Edge 1 in 70a | 3 | — |
| E6 | At 72e | Falling Edge 1 in 70c | | 3 |
| E7 | At 72f | Falling Edge 1 in 70b | 4 | — |
| E8 | Between 72f and 72g | Falling Edge 1 in 70d | | 4 |
| E9 | Between 72g and 72h | Rising Edge 2 in 70a | 5 | — |
| E10 | At 72h | Rising Edge 2 in 70c | | 5 |
| E11 | Between 72h and 72i | Rising Edge 2 in 70b | 6 | — |
| E12 | At 72i | Rising Edge 2 in 70d | | 6 |
| E13 | Between 72i and 72j | Falling Edge 2 in 70a | 7 | — |
| E14 | Between 72j and 72k | Falling Edge 2 in 70c | | 7 |
| E15 | Between 72k and 72l | Falling Edge 2 in 70b | 8 | — |

Having presented an explanation of how the signal events in an original measurement input signal map to a generated plurality of data streams, aspects of obtaining event measurements in such plurality of data streams are now presented. Although hereafter presented with respect to FIGS. 4 and 5, it should be appreciated that the following discussion similarly applies to the exemplary embodiments depicted in FIGS. 2 and 3. Since there is only one input comparator 22*a* illustrated in the exemplary embodiments of FIG. 4, it is assumed that the generated data streams 70*a*–70*d* are to be measured by a single measurement channel 12 as depicted in FIG. 1. It should be appreciated that when splitting a signal with an even higher frequency level that multiple measurement channels may be utilized. For a given maximum signal speed capability of measurement circuitry, there is a direct tradeoff between the number of channels needed to measure a data signal and the maximum frequency that data signal can be.

The exemplary signal splitting embodiment 40*b* may also be included after the input comparator 22*b* in measurement channel 12. The four parallel datastreams generated by the signal splitting circuitry may then be respectively provided to multiplexers 24*a* and 24*b* for subsequent selection and relay to respective interpolators 26*a* and 26*b*, where the desired signal events can be measured. Alternatively, the input comparators and signal splitting circuitry may be provided in a separate front-end module, and the plurality of generated datastreams can then be relayed to variously selected channels of a time measurement device.

It should be appreciated that the technology disclosed herein can also be used for multiple measurement channels, and also for measurements across measurement channels, such as when it is desired to measure the relative time difference (signal skew) between selected events in one measured signal versus selected events in another distinct input signal. To measure time differences between two such distinct input signals both characterized by high data rates, one input signal can be split into four (or more) data streams via signal splitting circuitry provided at measurement channel 12 while the other input signal can be split via signal splitting circuitry provided at measurement channel 14. Assuming that the arming circuitry for the respective interpolators in measurement channels 12 and 14 are capable of selecting any signal event in the generated data streams to be measured, then any cross-channel skew measurements are enabled.

Referring again to Table 1, consider obtaining information about the rising and falling edges in signal 36' by taking measurements of the generated data streams 70*a*–70*d*. To determine the corresponding event number for each transition measurement in signals 70*a*–70*d*, the following formulas can be used:

(If on data stream 70*a*): Rising Edge Event Count=((70*a* Edge Count)*2)−1

(If on data stream 70*b*): Rising Edge Event Count=((70*b* Edge Count)*2)

(If on data stream 70*c*): Falling Edge Event Count=((70*c* Edge Count)*2)−1

(If on data stream 70*d*): Falling Edge Event Count=((70*d* Edge Count)*2)

where "Edge Count" is a count of the number of transitions on that particular data stream from the beginning of the data stream, regardless of edge polarity.

In cases where the measurement input signal is a high speed clock signal whose frequency is to be measured in accordance with the present invention, the frequency calculation is obtained by taking the determined Event Count and then dividing by the amount of time taken for those events to occur. This is only valid for a clock signal, where each data stream in a 1:4 signal generation such as depicted in FIG. 4 has a signal period of 4*T, where T is the original measurement input signal period. In other words:

$$\text{Clock Signal Frequency} = \frac{(4 * \#\ \text{Events in a Data Stream})}{\text{Time for the Events to Happen}}.$$

For a single period measurement using the signal measurement systems and signal splitting circuitry disclosed herein, the 1:4 signal generation such as depicted in FIG. 4 places all rising edges on the signals 70*a* and 70*b* and all falling edges on the signals 70*c* and 70*d*. If the first edge for a single period measurement is on signal 70*a*, then the second edge would be on signal 70*b*, and vice versa. Thus, the measurement of a single period measurement on the original input signal converts to a skew measurement between signals 70*a* and 70*b* (or between 70*b* and 70*a*).

An aspect to consider in taking skew measurements across the data streams generated by signal splitting circuitry lies in determining whether the measurements need to be taken from a rising to falling, rising to rising, falling to rising, or falling to falling signal edge transition, depending on where the edge transitions in the original measurement signal are placed with regard to the original event count. However, since the event count of the first measured edge of an original measurement signal is always known, determining correct skew measurements can be precisely configured. For example, consider again the timing information depicted in FIG. 5 and Table 1 for rising edges only. Table 2 below provides the determined relationships between original rising edge signal events in signal 36', the rising edge event count in signal 36', the equivalent event locations in data streams 70*a* and 70*b*, and the polarity of the time interval measurement for each desired skew measurement.

TABLE 2

| Events in Signal 36' to use for Period Measurement: | Corresponding Rising Edge Event Count on Signal 36': | Equivalent Events in Data Streams 70a–70d for Measurement: | "Polarity" of the time interval measurement: |
|---|---|---|---|
| E1 to E3 | 1 to 2 | Rising Edge 1 in 70a to Rising Edge 1 in 70b | rise to rise |
| E3 to E5 | 2 to 3 | Rising Edge 1 in 70b to Falling Edge 1 in 70a | rise to fall |
| E5 to E7 | 3 to 4 | Falling Edge 1 in 70a to Falling Edge 1 in 70b | fall to fall |
| E7 to E9 | 4 to 5 | Falling Edge 1 in 70b to Rising Edge 2 in 70a | fall to rise |
| E9 to E11 | 5 to 6 | Rising Edge 2 in 70a to Rising Edge 2 in 70b | rise to rise |
| E11 to E13 | 6 to 7 | Rising Edge 2 in 70b to Falling Edge 2 in 70a | rise to fall |
| E13 to E15 | 7 to 8 | Falling Edge 2 in 70a to Falling Edge 2 in 70b | fall to fall |

It should be appreciated that measurement types in addition to period, frequency, and skew measurements are contemplated in accordance with the disclosed technology and should be within the scope of the present invention.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A signal measurement system for measuring relative timing of signal events in at least one measurement signal, said signal measurement system comprising:

input circuitry for receiving a measurement signal, wherein said input circuitry is configured to convert the measurement signal into a timing signal indicative of selected events of the measurement signal, wherein said timing signal is characterized by a first frequency level;

signal splitting circuitry configured to receive the timing signal from said input circuitry and to split the timing signal a predetermined number of times and to generate at least first and second datastreams characterized by a second frequency, said second frequency being lower than said first frequency; and measurement circuitry for obtaining measurements between selected events in said at least first and second datastreams.

2. A signal measurement system as in claim 1, wherein the predetermined number of times the timing signal is split by said signal splitting circuitry is proportional to the ratio of said first frequency to said second frequency.

3. A signal measurement system as in claim 1, wherein said signal splitting circuitry comprises a plurality of edge-triggered devices provided in a cascaded series of groups such that the number of groups in the cascaded series of edge-triggered devices is equal to the predetermined number of times the timing signal is split.

4. A signal measurement system as in claim 3, wherein said signal splitting circuitry further comprises:

a plurality of logic gates coupled between selected groups of the cascaded series of edge-triggered devices; and a plurality of delay elements coupled between selected inputs and outputs of said plurality of logic gates.

5. A signal measurement system as in claim 1, wherein said signal splitting circuitry generates at least four datastreams and wherein said measurement circuitry obtains skew measurements between selected signal events in said at least four datastreams.

6. A signal measurement system as in claim 1, wherein said measurement circuitry comprises a plurality of measurement channels each including at least one interpolator, and wherein the at least first and second datastreams generated by said signal splitting circuitry are provided to selected measurement channels of the measurement circuitry.

7. A time measurement device for measuring relative timing of changes in a signal, said time measurement device comprising:

an input for receiving an input signal characterized by a first frequency level;

a first plurality of edge-triggered devices configured to receive said input signal and to generate a first plurality of datastreams that are characterized by a second frequency level, wherein the second frequency level is less than the first frequency level; and a second plurality of edge-triggered devices configured to receive selected of said first plurality of datastreams and to generate a second plurality of datastreams that are characterized by a third frequency level, wherein the third frequency level is less than the second frequency level.

8. A time measurement device as in claim 7, further comprising a comparator for configuring said input signal into a generally binary signal format.

9. A time measurement device as in claim 7, wherein said first and second pluralities of edge-triggered devices are flip-flops and wherein selected of the edge-triggered flip-flop outputs are fed back to the respective inputs of such selected flip-flops.

10. A time measurement device as in claim 7, wherein selected of said first and second pluralities of edge-triggered devices are configured to invert the input signal provided thereto.

11. A time measurement device as in claim 7, further comprising:

a plurality of logic gates coupled between said first plurality of edge-triggered devices and said second plurality of edge-triggered devices; and a plurality of delay elements coupled between selected inputs and outputs of said plurality of logic gates for implementing a timing delay of the signal provided thereto.

12. A time measurement device as in claim 11, wherein the respective timing delays implemented by said plurality of delay elements is less than or equal to one period of the input signal frequency.

13. A time measurement device as in claim 7, further comprising measurement circuitry configured to receive selected of said second plurality of datastreams and to obtain time-stamped measurements of selected signal events within said second plurality of datastreams.

14. A time measurement device as in claim 13, wherein said measurement circuitry is configured to take timing skew measurements between selected events in different datastreams selected from said first and second pluralities of datastreams.

15. A method of measuring relative timing changes in an input signal, said method comprising the following steps:

providing a measurement signal characterized by a first frequency level;

splitting the measurement signal a predetermined number of times to generate at least first and second datastreams characterized by a second frequency level, wherein said second frequency level is lower than said first frequency level; and obtaining time-stamped measurements of selected signal events within said at least first and second datastreams.

16. A method as in claim 15, wherein the predetermined number of times the measurement signal is split in said splitting step is proportional to the ratio of said first frequency to said second frequency.

17. A method as in claim 15, wherein said splitting step is repeated to generate at least four datastreams and wherein said step of obtaining time-stamped measurements comprises obtaining skew measurements between selected signal events in said at least four datastreams.

18. A method as in claim 15, further comprising the step of configuring said measurement signal into a generally binary signal format before said splitting step.

19. A method as in claim 15, wherein said splitting step comprises providing the measurement signal to a plurality of edge-triggered devices arranged in a cascaded series of groups such that the number of groups in the cascaded series is proportional to the predetermined number of times the timing signal is split.

20. A method as in claim 15, wherein said step of obtaining time-based measurements is effected by a plurality of interpolators, and wherein the second frequency level of said at least first and second datastreams is less than the maximum effective operating frequency of the interpolators.

* * * * *